US007957686B2

(12) United States Patent
Shida

(10) Patent No.: US 7,957,686 B2
(45) Date of Patent: Jun. 7, 2011

(54) IMAGE FORMING APPARATUS AND FUSER UNIT CLEANING METHOD

(75) Inventor: Koji Shida, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 137 days.

(21) Appl. No.: 12/340,172

(22) Filed: Dec. 19, 2008

(65) Prior Publication Data

US 2009/0162088 A1 Jun. 25, 2009

Related U.S. Application Data

(60) Provisional application No. 61/015,180, filed on Dec. 19, 2007.

(51) Int. Cl.
*G03G 15/20* (2006.01)

(52) U.S. Cl. ..... 399/327; 399/322

(58) Field of Classification Search ..... 399/68, 399/322, 327

See application file for complete search history.

(56) References Cited

U.S. PATENT DOCUMENTS

| | | | | |
|---|---|---|---|---|
| 5,138,390 | A * | 8/1992 | Miyabayashi et al. | 399/327 X |
| 5,142,340 | A * | 8/1992 | Farrell et al. | 399/327 |
| 6,845,225 | B2 * | 1/2005 | Toyoda et al. | 399/327 |
| 7,711,302 | B2 * | 5/2010 | Ueda | 399/327 |
| 7,720,422 | B2 * | 5/2010 | Son et al. | 399/327 |

FOREIGN PATENT DOCUMENTS

| | | |
|---|---|---|
| JP | P2001-265152 | 9/2001 |
| JP | P2004-309569 | 11/2004 |
| JP | P2005-003784 | 1/2005 |

* cited by examiner

*Primary Examiner* — Sandra L Brase
(74) *Attorney, Agent, or Firm* — Patterson & Sheridan, LLP

(57) ABSTRACT

An image forming apparatus includes a fuser unit that includes a first roller and a second roller opposite to each other, a first conveyance unit, a second conveyance unit, a drive unit, and a control unit to control the drive unit to rotate one or both of the first roller and the second roller in a state where a sheet contacts with the first roller and the second roller and the sheet is held by the first conveyance unit and the second conveyance unit, or in a state where after the sheet is held by the first conveyance unit and the second conveyance unit, one or both of the first conveyance unit and the second conveyance unit move in a direction of approaching at least one of the first roller and the second roller and the sheet contacts with the first roller or the second roller.

17 Claims, 8 Drawing Sheets

IMAGE FORMING APPARATUS AND FUSER UNIT CLEANING METHOD

CROSS-REFERENCE TO RELATED APPLICATIONS

This application is based upon and claims the benefit of priority from U.S. provisional application 61/015,180, filed on Dec. 19, 2007, the entire contents of which is incorporated herein by reference.

TECHNICAL FIELD

The present invention relates to an image forming apparatus and a fuser unit cleaning method, and particularly to an image forming apparatus and a fuser unit cleaning method in which a fuser unit can be cleaned.

BACKGROUND

Hitherto, in an MFP (Multi Function Peripheral), a fuser unit to fix a color toner image onto a sheet is cleaned by using a cleaner web, a fuser wick, an oil roll or the like. When the fuser unit is cleaned by using the cleaner web or the like, it becomes necessary to provide a dedicated mechanism, and it is necessary to consider the usable life of consumables included in the dedicated mechanism. Then, a multi function peripheral is proposed in which when a fuser unit is cleaned without using a cleaner web or the like, a sheet is passed through the fuser unit, so that dirt existing on the fuser unit is cleaned, and a reduction in print quality can be prevented. This technique is disclosed in JP-A-2002-200722.

However, in the technique disclosed in JP-A-2002-200722, since the sheet passed through the fuser unit merely contacts with the fixing roller of the fuser unit, the dynamic friction is not caused, and there is a problem that the fuser unit cannot be sufficiently cleaned.

SUMMARY

The present invention is made in view of such circumstances, and it is an object thereof to provide an image forming apparatus and a fuser unit cleaning method in which a sheet is passed through a fuser unit so that the dirt of the fuser unit can be suitably cleaned.

According to an aspect of the invention, in order to solve the problem, an image forming apparatus includes a fuser unit that includes a first roller and a second roller opposite to each other and fixes image onto a sheet, a first conveyance unit that is provided upstream of the fuser unit in a sheet conveyance direction and conveys the sheet, a second conveyance unit that is provided downstream of the fuser unit in the sheet conveyance direction and conveys the sheet, a drive unit to rotate the first roller and the second roller of the fuser unit, and a control unit to control the drive unit to rotate one or both of the first roller and the second roller in a state where a sheet contacts with the first roller and the second roller and the sheet is held by the first conveyance unit and the second conveyance unit, or in a state where after the sheet is held by the first conveyance unit and the second conveyance unit, one or both of the first conveyance unit and the second conveyance unit move in a direction of approaching at least one of the first roller and the second roller and the sheet contacts with the first roller or the second roller.

According to another aspect of the invention, in order to solve the problem, an image forming apparatus includes a fuser unit that includes a first roller and a second roller opposite to each other and fixes image onto a sheet, a first conveyance unit that is provided upstream of the fuser unit in a sheet conveyance direction and conveys the sheet, a second conveyance unit that is provided downstream of the fuser unit in the sheet conveyance direction and conveys the sheet, a conveyance drive unit to drive the first conveyance unit and the second conveyance unit, and a control unit to control the first conveyance unit and the second conveyance unit to move a sheet in the sheet conveyance direction or in the direction opposite to the sheet conveyance direction or in both the directions in a state where the sheet contacts with the first roller and the second roller, or in a state where after the sheet is held by the first conveyance unit and the second conveyance unit, one or both of the first conveyance unit and the second conveyance unit move in a direction of approaching at least one of the first roller and the second roller and the sheet contacts with the first roller or the second roller.

According to still another aspect of the invention, in order to solve the problem, in a fuser unit cleaning method for an image forming apparatus including a fuser unit that includes a first roller and a second roller opposite to each other and fixes image onto a sheet, a first conveyance unit that is provided upstream of the fuser unit in a sheet conveyance direction and conveys the sheet, a second conveyance unit that is provided downstream of the fuser unit in the sheet conveyance direction and conveys the sheet, and a drive unit to rotate the first roller and the second roller of the fuser unit, the fuser unit cleaning method includes rotating one or both of the first roller and the second roller in a state where a sheet contacts with the first roller and the second roller and the sheet is held by the first conveyance unit and the second conveyance unit, or in a state where after the sheet is held by the first conveyance unit and the second conveyance unit, one or both of the first conveyance unit and the second conveyance unit move in a direction of approaching at least one of the first roller and the second roller and the sheet contacts with the first roller or the second roller.

According to still another aspect of the invention, in order to solve the problem, in a fuser unit cleaning method for an image forming apparatus including a fuser unit that includes a first roller and a second roller opposite to each other and fixes image onto a sheet, a first conveyance unit that is provided upstream of the fuser unit in a sheet conveyance direction and conveys the sheet, a second conveyance unit that is provided downstream of the fuser unit in the sheet conveyance direction and conveys the sheet, and a conveyance drive unit to drive the first conveyance unit and the second conveyance unit, the fuser unit cleaning method includes moving a sheet in the sheet conveyance direction or in the direction opposite to the sheet conveyance direction or in both the directions in a state where the sheet contacts with the first roller and the second roller, or in a state where after the sheet is held by the first conveyance unit and the second conveyance unit, one or both of the first conveyance unit and the second conveyance unit move in a direction of approaching at least one of the first roller and the second roller and the sheet contacts with the first roller or the second roller.

DESCRIPTION OF THE DRAWINGS

In the accompanying drawings.

DETAILED DESCRIPTION

Hereinafter, an embodiment of the invention will be described with reference to the drawings.

Figure 1:
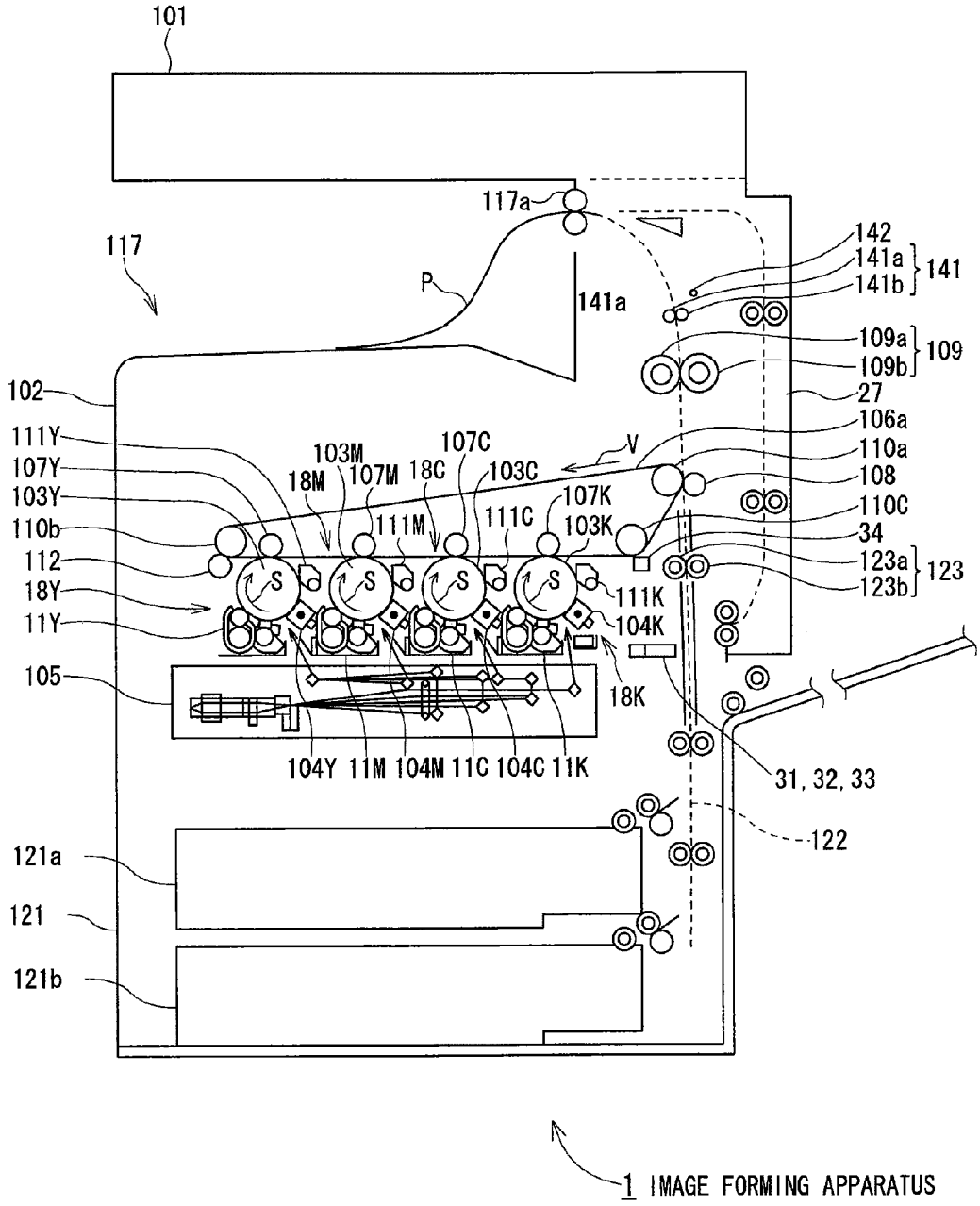
FIG. 1 is a view showing a structure of an image forming apparatus of an embodiment.

FIG. 1 shows a structure of an image forming apparatus 1 of an embodiment. As shown in FIG. 1, the image forming apparatus 1 includes a scanner unit 101 as an image scanning device, and a printer drive unit 102 as an image forming device. The scanner unit 101 scans an original document placed on a document stand glass. Besides, the image forming apparatus 1 includes a sheet feeding unit 121 to feed a sheet P in a direction toward the printer drive unit 102. In the sheet feeding unit 121, the sheet P is taken out from a sheet feeding cassette 121*a* or a sheet feeding cassette 121*b*, and the sheet P is fed along a conveyance path 122 in a direction toward a register roller 123. The register roller 123 is a conveyance roller to convey the sheet P and includes a fixed roller 123*a* and a movable roller 123*b*.

The printer drive unit 102 includes four sets of image forming units 18 using an electrophotographic system using four-tandem reversal development. The image forming unit 18 includes four sets of yellow (Y), magenta (M), cyan (C) and black (K), and they are disposed in parallel along the lower side of an intermediate transfer belt 106*a*. Each of image forming units 18Y, 18M, 18C and 18K has the same structure. Charging units 104Y, 104M, 104C and 104K, developing units 11Y, 11M, 11C and 11K, and photoconductive cleaners 111Y, 111M, 111C and 111K are disposed around photoconductive drums 103Y, 103M, 103C and 103K of the image forming units 18Y, 18M, 18C and 18K along a rotation direction of an arrow S.

A laser optical system unit 105 irradiates laser beams to the respective photoconductive drums 103Y, 103M, 103C and 103K between the charging units 104Y, 104M, 104C and 104K and the developing units 11Y, 11M, 11C and 11K disposed around the photoconductive drums. The respective image forming units 18Y, 18M, 18C and 18K form toner images on the photoconductive drums 103Y, 103M, 103C and 103K.

The photoconductive drums 103Y, 103M, 103C and 103K are supported by a unit frame integrally with the charging units 104Y, 104M, 104C and 104K, and can form process units.

A required tensile force is given to the intermediate transfer belt 106*a* by a drive roller 110*a*, a driven roller 110*b*, and a tension roller 110*c*. A belt cleaner 112 is disposed in the vicinity of the driven roller 110*b*. Primary transfer rollers 107Y, 107M, 107C and 107K are disposed at primary transfer positions opposite to the photoconductive drums 103Y, 103M, 103C and 103K through the intermediate transfer belt 106*a*. A secondary transfer roller 108 is disposed at a secondary transfer position opposite to the drive roller 110*a* through the intermediate transfer belt 106*a*. The sheet P is fed to the secondary transfer position from the sheet feeding cassette 121*a* or 121*b* through the conveyance path 122. The secondary transfer roller 108 secondarily transfers a color toner image formed of plural color toner images superimposed on the intermediate transfer belt 106*a* to the sheet P. A density sensor 34 is provided in the vicinity of the intermediate transfer belt 106*a* before reaching the drive roller 110*a*, and detects the density of the toner image formed on the intermediate transfer belt 106*a*.

The printer drive unit 102 includes a fuser unit 109 to fix the color toner image on the sheet P transferred by the secondary transfer roller 108 onto the sheet P, and a paper discharge roller 117*a* to discharge the sheet P after fixation to a paper discharge unit 117. The fuser unit 109 includes a press roller 109*a* and a heat roller 109*b*. A conveyance roller 141 to convey the sheet P is provided at the downstream side of the fuser unit 109. The conveyance roller 141 includes a fixed roller 141*a* and a movable roller 141*b*. A sensor 142 to detect that the sheet P is conveyed to a required position is provided in the vicinity of the conveyance roller 141. The printer drive unit 102 includes a reversal conveyance mechanism 27 to reverse the sheet P when a two-sided image is formed. Besides, the printer drive unit 102 includes a temperature sensor 31, an atmospheric pressure sensor 32 and a relative humidity sensor 33.

The image forming apparatus 1 scans an original document by the scanner unit 101 when the operation of an image forming process starts. The printer drive unit 102 drives the respective image forming units 18Y, 18M, 18C and 18K, and rotates the intermediate transfer belt 106*a* in an arrow V direction. The photoconductive drums 103Y, 103M, 103C and 103K rotate in the arrow S direction, and are charged by the charging units 104Y, 104M, 104C and 104K. The laser optical system unit 105 forms electrostatic latent images corresponding to an original document image on the photoconductive drums 103Y, 103M, 103C and 103K. The developing units 11Y, 11M, 11C and 11K form toner images on the photoconductive drums 103Y, 103M, 103C and 103K.

The toner images on the photoconductive drums 103Y, 103M, 103C and 103K are sequentially superimposed on the intermediate transfer belt 106*a* by the primary transfer rollers 107Y, 107M, 107C and 107K. A color toner image is formed on the intermediate transfer belt 106*a*. The color toner image formed on the intermediate transfer belt 106*a* is collectively secondarily transferred onto the sheet P by the secondary transfer roller 108 at the secondary transfer position. The sheet P is conveyed from the sheet feeding unit 121 at the timing when the color toner image on the intermediate transfer belt 106*a* reaches the secondary transfer position. The fuser unit 109 fixes the color toner image onto the sheet P.

After the toner image is secondarily transferred onto the sheet P, the belt cleaner 112 cleans the remaining toner. The photoconductive cleaners 111Y, 111M, 111C and 111K remove the remaining toner on the photoconductive drums 103Y, 103M, 103C and 103K. The charge-removal units 113Y, 113M, 113C and 113K remove remaining charges on the photoconductive drums 103Y, 103M, 103C and 103K.

Figure 2:
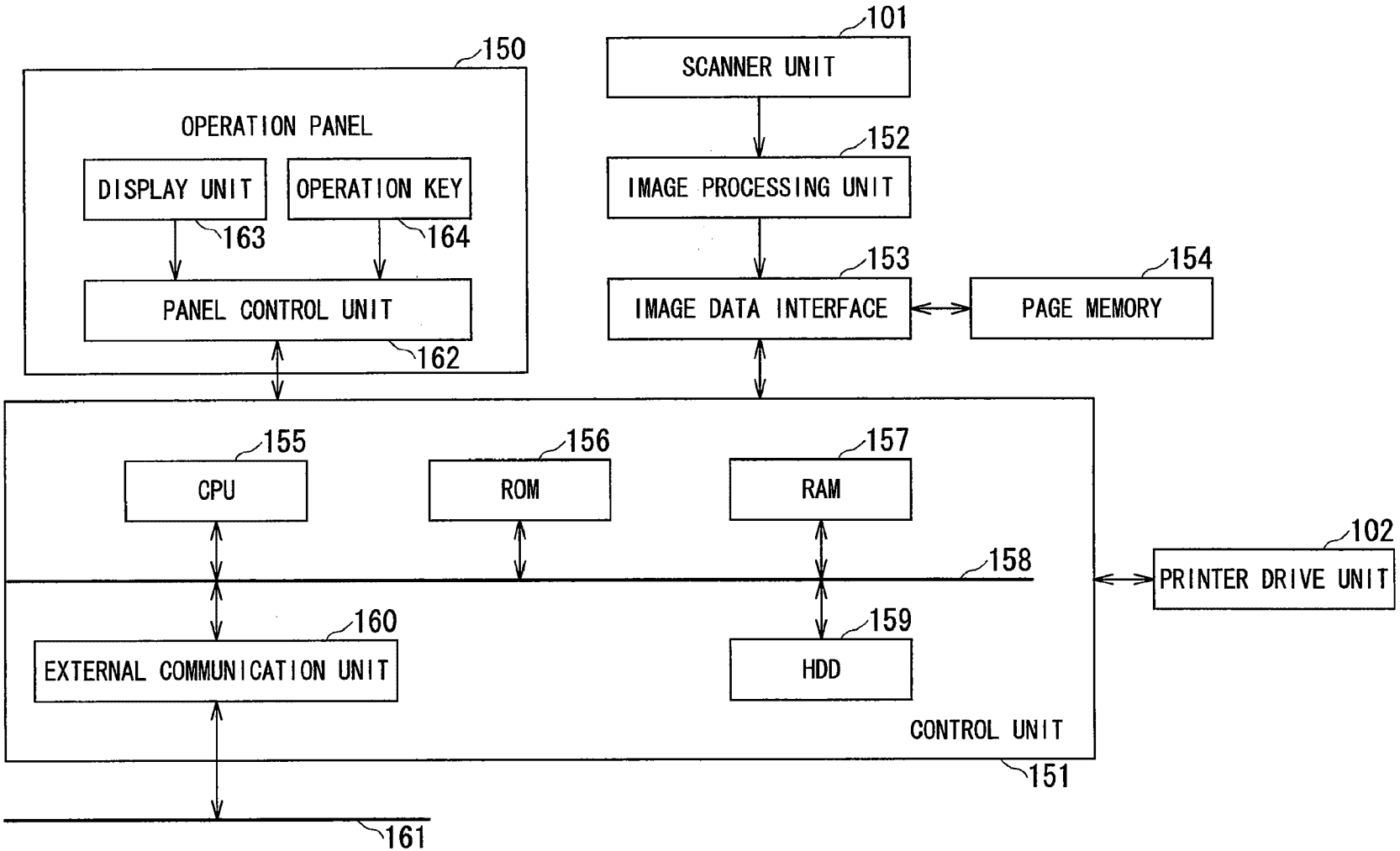
FIG. 2 is a block diagram showing a structure of a control system of the image forming apparatus of the embodiment.

FIG. 2 shows a structure of a control system of the image forming apparatus 1 of the embodiment. Incidentally, components corresponding to those of FIG. 1 are denoted by the same reference numerals. As shown in FIG. 2, the image forming apparatus 1 includes a scanner unit 101, a printer drive unit 102, an operation panel 150, a control unit 151, an image processing unit 152, an image data interface 153, and a page memory 154. The control unit 151 includes a CPU (Central Processing Unit) 155, a ROM (Read Only Memory)

156, a RAM (Random Access Memory) 157, a bus 158, a HDD (Hard Disk Drive) 159 and an external communication unit 160. The CPU 155 executes various processings in accordance with programs stored in the ROM 156 or various application programs loaded from the HDD 159 to the RAM 157, and generates various control signals to supply them to the respective units so that the image forming apparatus 1 is collectively controlled. The RAM 157 suitably stores data necessary for the CPU 155 to execute the various processings. The CPU 155, the ROM 156, the RAM 157, and the HDD 159 are mutually connected through the bus 158. Besides, the external communication unit 160 including a modem, a terminal adapter, and a network interface is connected to the bus 158. The external communication unit 160 performs a communication process through a network 161.

The control unit 151 is connected to the printer drive unit 102, the operation panel 150, and the image data interface 153. The operation panel 150 includes a panel control unit 162, a display unit 163, and an operation key 164. The display unit 163 includes, for example, an LCD (Liquid Crystal Display). The image data interface 153 is connected to the image processing unit 152 and the page memory 154. The image processing unit 152 is connected to the scanner unit 101. Here, the flow of image data when an image is formed will be described. When an original document is placed on the document stand glass, the image data of the original document is read by the scanner unit 101, and the read image data is supplied to the image processing unit 152. The image processing unit 152 acquires the image data of the original document supplied from the scanner unit 101, and performs, for example, shading correction, various filtering processes, gradation process, gamma process and the like on the acquired image data. The image data after these processes is stored in the page memory 154 through the image data interface 153 as the need arises. The printer drive unit 102 operates in accordance with the control of the control unit 151.

Figure 3:
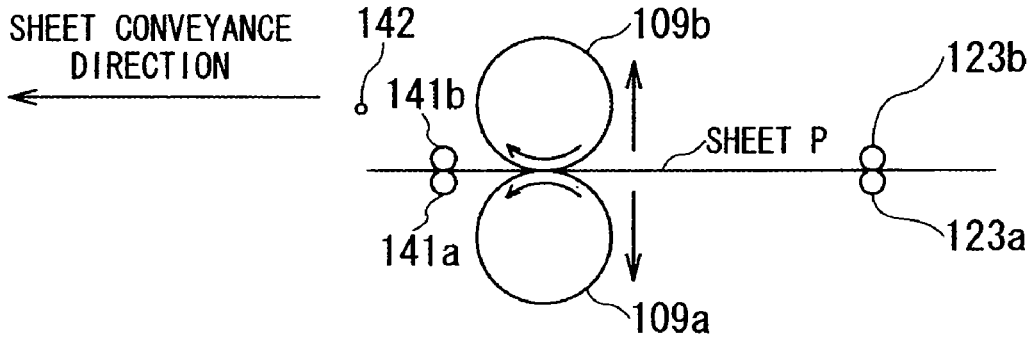
FIG. 3 is an explanatory view for explaining a first cleaning method of a fuser unit.

In this embodiment, as one method of cleaning dirt of the fuser unit 109 without a dedicated mechanism, as shown in FIG. 3, contact pressure between the press roller 109*a* and the heat roller 109*b* included in the fuser unit 109 is previously weakened, and nip pressure when the sheet P is nipped between the press roller 109*a* and the heat roller 109*b* is previously weakened. Thereafter, the sheet P is conveyed to a position of the fuser unit 109, and the sheet P is fixed (held) at the position. In the state where the sheet P is fixed (held), the press roller 109*a* and the heat roller 109*b* of the fuser unit 109 are driven and slipped. As a result, the dirt of the fuser unit 109 can be cleaned without using a dedicated mechanism. Hereinafter, a fuser unit cleaning process using this method (first cleaning method of the fuser unit) will be described.

The fuser unit cleaning process in the image forming apparatus 1 of FIG. 2 will be described with reference to a flowchart of FIG. 4. In Act 1, the control unit 151 starts a cleaning mode of the fuser unit 109. In Act 2, the control unit 151 controls the operation panel 150, and causes a UI screen to display that the cleaning mode of the fuser unit 109 occurs. The display unit 163 of the operation panel 150 displays, in accordance with the control of the panel control unit 162, the cleaning mode of the fuser unit 109 on the UI screen. In Act 3, the control unit 151 drives the press roller 109*a* and the heat roller 109*b* of the fuser unit 109, and weakens the contact pressure between the press roller 109*a* and the heat roller 109*b*. As a result, the nip pressure when the sheet P is nipped between the press roller 109*a* and the heat roller 109*b* can be previously weakened.

In Act 4, the control unit 151 controls the printer drive unit 102, and starts to feed the sheet P for cleaning the fuser unit 109 from the sheet feeding cassette 121. At this time, in Act 5, the control unit 151 uses the sensor 142 and starts to detect the position of the sheet P. The sensor 142 detects whether the sheet P is conveyed to a required position. That is, the sensor 142 detects whether the sheet P is conveyed to the position where the sheet P extends over all of the register roller 123, the fuser unit 109 and the conveyance roller 141 and can clean the fuser unit 109. Incidentally, the sensor 142 is set to be ON (High) in the state where the sheet P extends over all of the register roller 123, the fuser unit 109 and the conveyance roller 141. In Act 6, the control unit 151 controls the register roller 123 and the conveyance roller 141, starts to drive the register roller 123 (the fixed roller 123*a* and the movable roller 123*b*) and the conveyance roller 141 (the fixed roller 141*a* and the movable roller 141*b*), and conveys the sheet P for cleaning the fuser unit to the required position.

In Act 7, the control unit 151 uses the sensor 142 to determine whether the sheet P is conveyed to the required position. In Act 7, if the control unit 151 determines that the sheet P is not conveyed to the required position, the process returns to Act 6. On the other hand, in Act 7, if the control unit 151 determines that the sheet P is conveyed to the required position, in Act 8, the control unit 151 drives the register roller 123 and the conveyance roller 141, and holds the sheet P at the position by the register roller 123 and the conveyance roller 141. As a result, the sheet P is fixed at the position where the sheet P extends over all of the register roller 123, the fuser unit 109 and the conveyance roller 141 and can clean the fuser unit 109.

In Act 9, the control unit 151 controls the press roller 109*a* and the heat roller 109*b* of the fuser unit 109, starts to drive the press roller 109*a* and the heat roller 109*b* and rotates the two rollers. Thus, the dynamic friction is applied to the fuser unit 109 by the sheet P for cleaning the fuser unit, and the dirt existing on the fuser unit 109 is cleaned. In Act 10, the control unit 151 determines whether a cleaning cumulative time of the fuser unit 109 reaches a previously set time (for example, five minutes). In Act 10, if the control unit 151 determines that the cleaning cumulative time of the fuser unit 109 does not reach the previously set time, the process returns to Act 9, and the fuser unit 109 is cleaned until the cleaning cumulative time reaches the previously set time. On the other hand, in Act 10, if the control unit 151 determines that the cleaning cumulative time of the fuser unit 109 reaches the previously set time, in Act 11, the control unit 151 controls the press roller 109*a* and the heat roller 109*b* of the fuser unit 109, and stops the rotation of the press roller 109*a* and the heat roller 109*b*. Thereafter, in Act 12, the control unit 151 drives the register roller 123 and the conveyance roller 141, and releases the holding of the sheet P by the register roller 123 and the conveyance roller 141.

In Act 13, the control unit 151 controls the register roller 123 and the conveyance roller 141, starts to drive the register roller 123 and the conveyance roller 141, and conveys the sheet P used for the cleaning of the fuser unit 109 to the discharge unit 117. In Act 14, the discharge unit 117 discharges the sheet P after the cleaning of the fuser unit to a position different from a position in a case where the sheet P on which the print is fixed is discharged in accordance with the control of the control unit 151. In Act 15, the control unit 151 ends the cleaning mode of the fuser unit 109.

Figure 4:
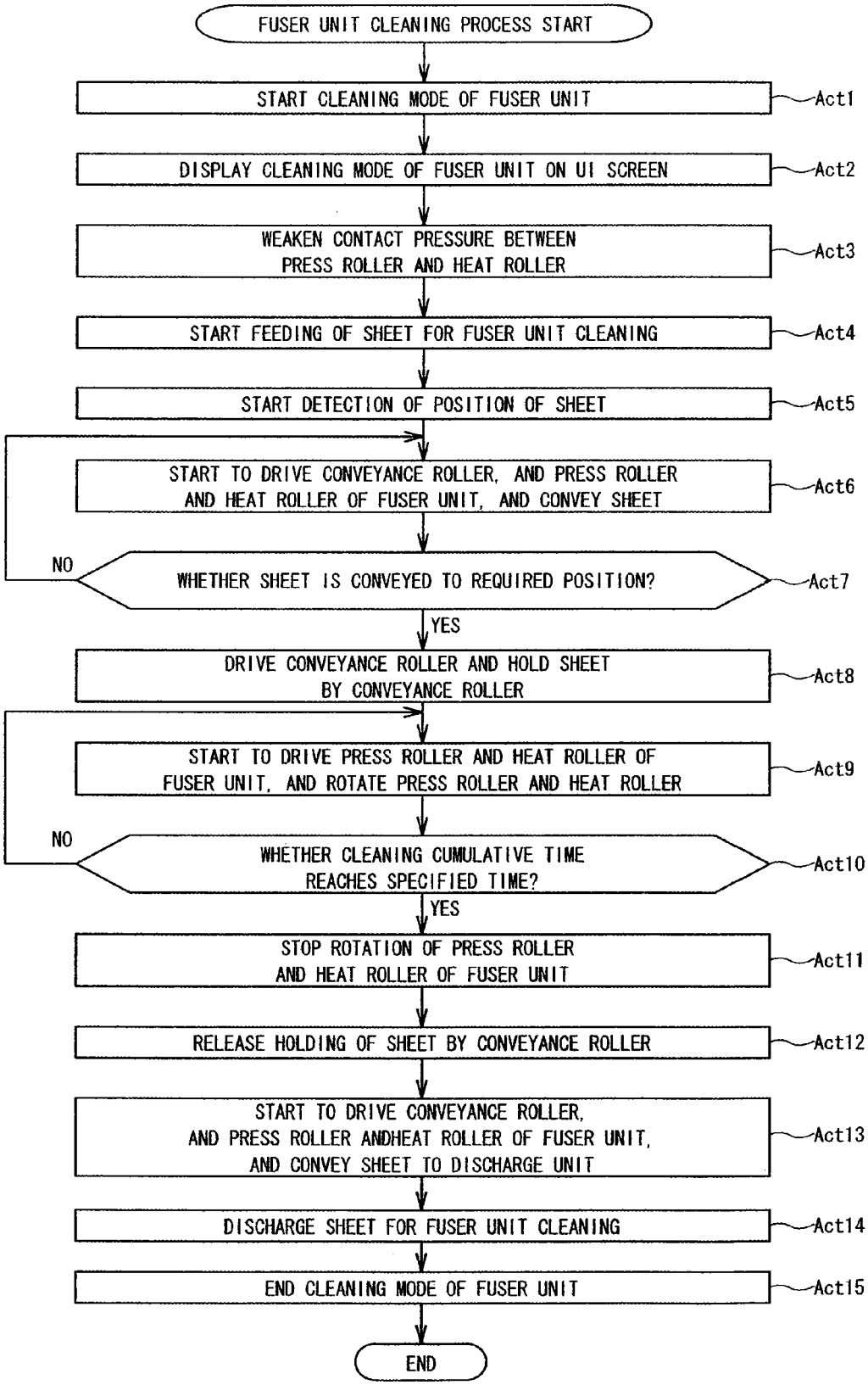
FIG. 4 is a flowchart for explaining a fuser unit cleaning process using the first cleaning method of the fuser unit in the image forming apparatus of FIG. 2.

Incidentally, in the fuser unit cleaning process of FIG. 4, after the sheet P for cleaning the fuser unit is held at the two places, the press roller 109*a* and the heat roller 109*b* of the fuser unit 109 are rotated. However, no limitation is made to such a case. For example, the fuser unit 109 is not rotated, but the register roller 123 and the conveyance roller 141 may be driven to move the sheet P in either one of the back and forth directions or the two directions of the back and forth directions. A fuser unit cleaning process in this case is shown in a flowchart of FIG. 5. Incidentally, in the operation of FIG. 5, with respect to portions corresponding to those of the operation of FIG. 4, their description will be appropriately omitted since the description is repetitive. Further, the same acts as those in FIG. 4 denote the same ones, and a description thereof is not given again.

In Act 21, the control unit 151 controls the register roller 123 and the conveyance roller 141, starts to drive the register roller 123 and the conveyance roller 141 without rotating the fuser unit 109, and moves the sheet P used for cleaning of the fuser unit 109 in either one of the back and forth directions or the two directions of the back and forth directions. Specifically, the sheet P for cleaning the fuser unit is moved in the sheet conveyance direction of the sheet P or in its opposite direction, or is moved in both the directions. As a result, the dynamic friction is applied to the fuser unit 109 by the sheet P for cleaning the fuser unit, and the dirt existing on the fuser unit 109 is cleaned. Thereafter, the discharge unit 117 discharges the sheet P used for the cleaning of the fuser unit 109.

Figure 5:
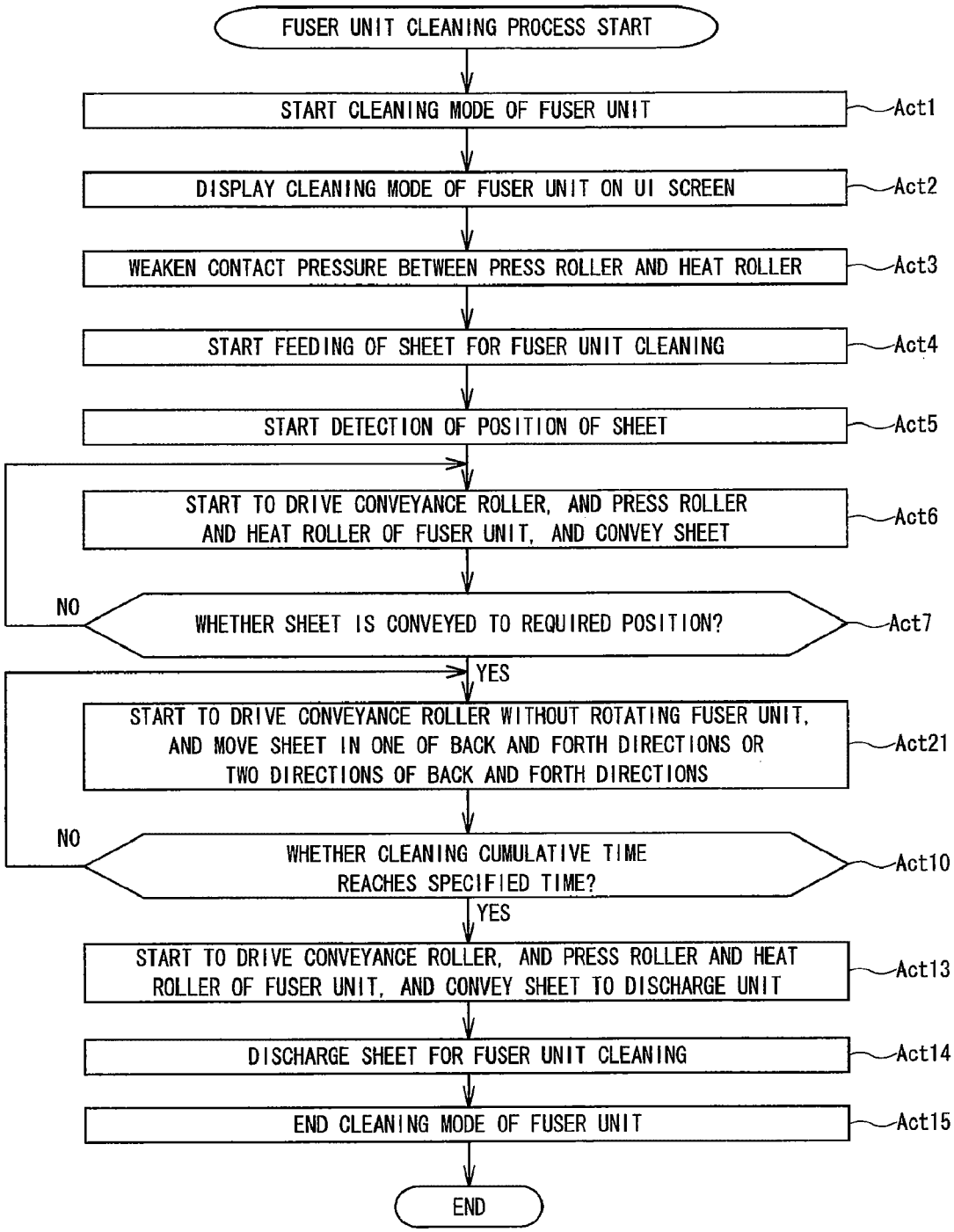
FIG. 5 is a flowchart for explaining another fuser unit cleaning process using the first cleaning method of the fuser unit in the image forming apparatus of FIG. 2.
Figure 6:
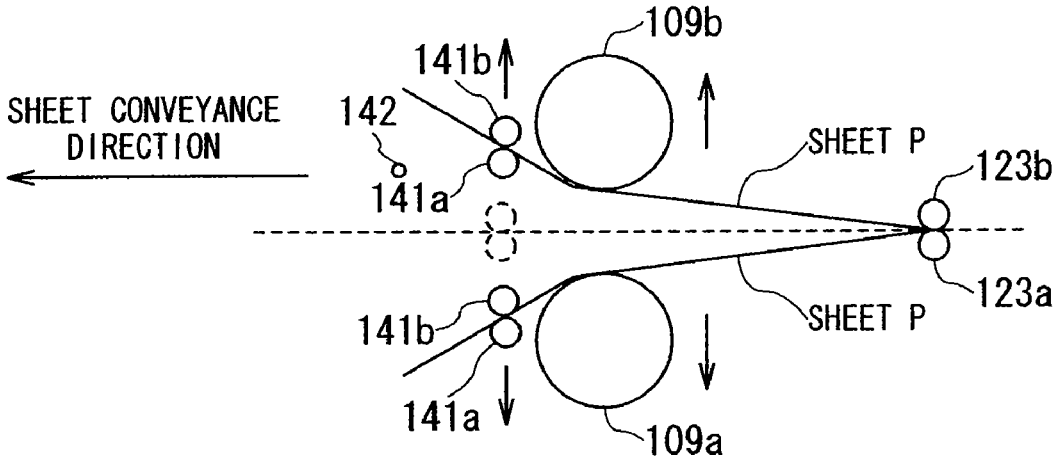
FIG. 6 is an explanatory view for explaining a second cleaning method of a fuser unit.

In the case of FIG. 4 and FIG. 5, the sheet P is conveyed to the position of the fuser unit 109, the sheet P is fixed at the position, and then, the press roller 109*a* and the heat roller 109*b* of the fuser unit 109 are driven and slipped. However, the embodiment is not limited to the case as stated above. For example, as shown in FIG. 6, the press roller 109*a* and the heat roller 109*b* included in the fuser unit 109 are separated from each other. Thereafter, the sheet P is conveyed to the position of the fuser unit 109, and the sheet P is held at the position by using the register roller 123 and the conveyance roller 141. In the state where the sheet P is held at the two places, for example, the conveyance roller 141 is moved in a direction of approaching the press roller 109*a* or the heat roller 109*b* of the fuser unit 109, and the sheet P is brought into contact with the press roller 109*a* or the heat roller 109*b* of the fuser unit 109. In the state where the sheet P is in contact with one of the press roller 109*a* and the heat roller 109*b* of the fuser unit 109, the press roller 109*a* and the heat roller 109*b* of the fuser unit 109 is driven and slipped. By this, the dirt of the fuser unit 109 can be cleaned without using a dedicated mechanism. Hereinafter, a fuser unit cleaning process using this method (second cleaning method of the fuser unit) will be described.

The fuser unit cleaning process in the image forming apparatus 1 of FIG. 2 will be described with reference to a flowchart of FIG. 7. Incidentally, in the operation of FIG. 7, with respect to portions corresponding to those of the operation of FIG. 4, their description will be appropriately omitted since the description is repetitive. Further, the same acts as those in FIG. 4 denote the same ones, and a description thereof is not given again.

In Act 51, the control unit 151 drives the press roller 109*a* and the heat roller 109*b* of the fuser unit 109, and the press roller 109*a* and the heat roller 109*b* are separated from each other by a required distance.

In Act 52, the control unit 151 moves either one (the conveyance roller 141 in the case of FIG. 6) of the register roller 123 and the conveyance roller 141 in a direction of approaching either one of the press roller 109*a* and the heat roller 109*b* of the fuser unit 109. As a result, the sheet P is brought into contact with the press roller 109*a* or the heat roller 109*b* of the fuser unit 109. Of course, the register roller 123 may be moved in a direction of approaching either one of the press roller 109*a* and the heat roller 109*b* of the fuser unit 109. Besides, both the register roller 123 and the conveyance roller 141 may be made to approach the fuser unit 109. Thereafter, in Act 53 and Act 54, the press roller 109*a* or the heat roller 109*b* of the fuser unit 109 is rotated, and the fuser unit 109 is cleaned for a previously set time.

In Act 54, if the control unit 151 determines that the cleaning cumulative time of the fuser unit 109 reaches the previously set time, the control unit 151 controls the press roller 109*a* or the heat roller 109*b* of the fuser unit 109, and stops the rotation of the press roller 109*a* or the heat roller 109*b*. Thereafter, in Act 55, the control unit 151 moves either one of the register roller 123 and the conveyance roller 141 (the conveyance roller 141 in the case of FIG. 6) in a direction of approaching the roller opposite to the previously-approached roller (the press roller 109*a* or the heat roller 109*b*) of the fuser unit 109. As a result, the sheet P is brought into contact with the press roller 109*a* or the heat roller 109*b* of the fuser unit 109. Thereafter, in Act 56 and Act 57, the press roller 109*a* or the heat roller 109*b* of the fuser unit 109 is rotated, and the fuser unit 109 is cleaned for the previously set time.

Thereafter, the process proceeds to Act 58.

Figure 7:
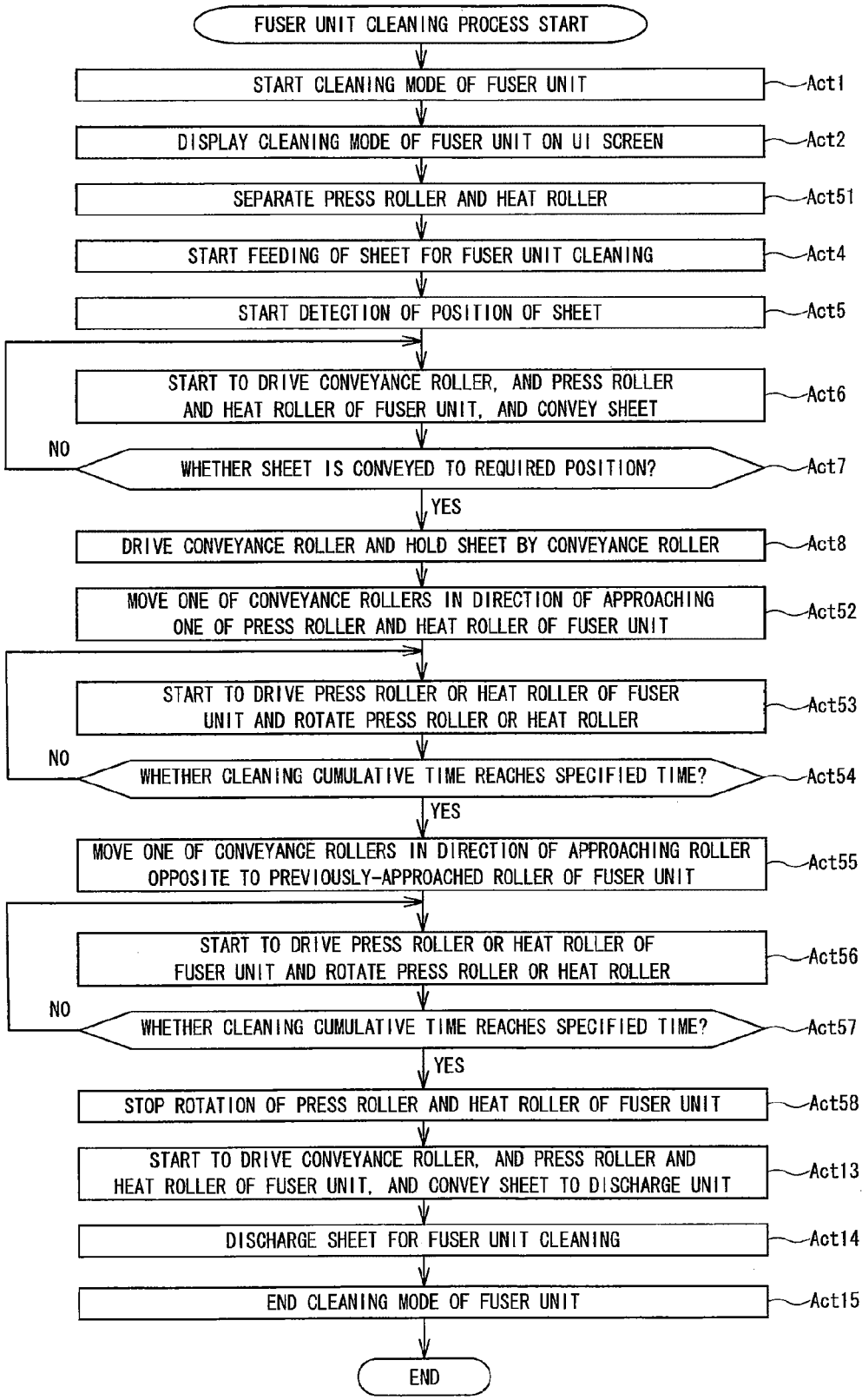
FIG. 7 is a flowchart for explaining a fuser unit cleaning process using the second cleaning method of the fuser unit in the image forming apparatus of FIG. 2.
Figure 8:
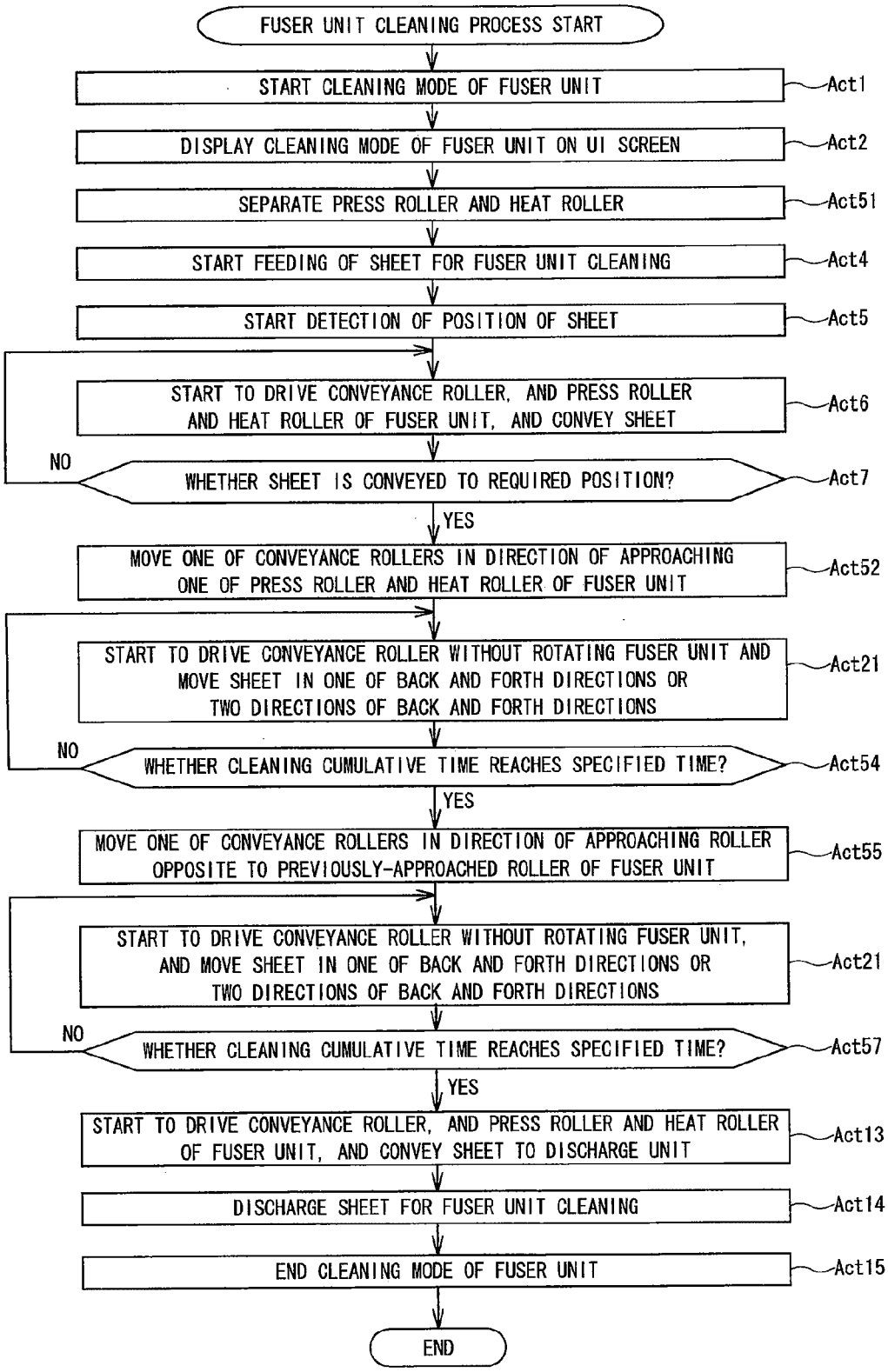
FIG. 8 is a flowchart for explaining another fuser unit cleaning process using the second cleaning method of the fuser unit in the image forming apparatus of FIG. 2.

Incidentally, also in the case of FIG. 7, for example, the fuser unit 109 is not rotated, but the register roller 123 and the conveyance roller 142 may be driven to move the sheet P in one of the back and forth directions or the two directions of the back and forth directions. A fuser unit cleaning process in this case is shown in a flowchart of FIG. 8. Incidentally, the operation of FIG. 8 is basically the combination of the operations of FIG. 5 and FIG. 7, and the description thereof will be omitted since the description is repetitive. Further, the same acts as those in FIGS. 4, 5 and 7 denote the same ones, and a description thereof is not given again.

In this embodiment, the fuser unit 109 includes the first roller (the press roller 109*a*) and the second roller (the heat roller 109*b*) opposite to each other and fixes image onto a sheet P, the first conveyance unit (the register roller 123) is provided upstream of the fuser unit 109 in the sheet conveyance direction and conveys the sheet P, the second conveyance unit (the conveyance roller 141) is provided downstream of the fuser unit 109 in the sheet conveyance direction and conveys the sheet P, the first roller and the second roller of the fuser unit 109 are rotated, and the printer drive unit 102 can be controlled to rotate one or both of the first roller and the second roller in a state where the sheet P contacts with the first roller and the second roller and the sheet is held by the first conveyance unit and the second conveyance unit, or in a state where after the sheet P is held by the first conveyance unit and the second conveyance unit, one or both of the first conveyance unit and the second conveyance unit move in a direction of approaching one or both of the first roller and the second roller and the sheet P contacts with the first roller or the second roller.

Besides, the first conveyance unit and the second conveyance unit are driven, and the first conveyance unit and the second conveyance unit can be controlled to move the sheet P in the sheet conveyance direction or in its opposite direction or in both the directions in a state where the sheet P contacts with the first roller and the second roller, or in a state where after the sheet P is held by the first conveyance unit and the second conveyance unit, one or both of the first conveyance unit and the second conveyance unit move in the direction of approaching one or both of the first roller and the second roller, and the sheet P contacts with the first roller or the second roller.

Thus, without using dedicated consumables such as a cleaner web, a fuser wick, or an oil roll, the dynamic friction is applied to the roller of the fuser unit 109, so that the fuser unit 109 can be sufficiently cleaned. Accordingly, the sheet P is passed through the fuser unit 109, so that the dirt of the fuser unit 109 can be suitably cleaned.

Incidentally, the structures shown in the embodiment can be suitably combined.

Although the series of processes described in the embodiment of the invention can be executed by software, it can be executed by hardware.

Besides, in the embodiment of the invention, although the example of the process is described in which the Act of the flowchart is performed in time series along the recited sequence, the Act may not be necessarily performed in time series, and a process in which the Act is performed in parallel or individually is also included.

What is claimed is:

1. An image forming apparatus comprising:

a fuser unit configured to fix an image onto a sheet, the fuser unit including a first roller and a second roller opposite to each other;

a first conveyance unit configured to convey the sheet, the first conveyance unit being provided upstream of the fuser unit in a sheet conveyance direction;

a second conveyance unit configured to convey the sheet, the second conveyance unit being provided downstream of the fuser unit in the sheet conveyance direction;

a drive unit configured to rotate the first roller and the second roller of the fuser unit; and a control unit configured to control the drive unit to rotate one or both of the first roller and the second roller in a state where a sheet contacts the first roller and the second roller and the sheet is held by the first conveyance unit and the second conveyance unit, or in a state where after the sheet is held by the first conveyance unit and the second conveyance unit, one or both of the first conveyance unit and the second conveyance unit move in a direction of approaching at least one of the first roller and the second roller and the sheet contacts the first roller or the second roller.

2. The apparatus according to claim 1, further comprising a detection unit configured to detect whether the sheet extends over all of the fuser unit, the first conveyance unit and the second conveyance unit.

3. The apparatus according to claim 2, wherein if the detection unit detects that the sheet extends over all of the fuser unit, the first conveyance unit and the second conveyance unit, the control unit controls to hold the sheet by the first conveyance unit and the second conveyance unit.

4. The apparatus according to claim 2, wherein the detection unit is a sensor.

5. The apparatus according to claim 1, wherein the first conveyance unit includes two rollers opposite to each other, the second conveyance unit includes two rollers opposite to each other, and each of the first conveyance unit and the second conveyance unit holds the sheet by nipping the sheet between the two rollers.

6. The apparatus according to claim 1, wherein the control unit controls the drive unit to rotate the first roller and the second roller until a previously set time elapses.

7. The apparatus according to claim 6, wherein the control unit controls the first conveyance unit and the second conveyance unit to release holding of the sheet by the first conveyance unit and the second conveyance unit after the first roller and the second roller rotates for the previously set time.

8. The apparatus according to claim 1, further comprising a discharge unit configured to discharge a sheet, wherein the discharge unit discharges the sheet conveyed after the first roller and the second roller are rotated in the state where the sheet is held by the first conveyance unit and the second conveyance unit to a position different from a position in a case where the sheet onto which the toner is fixed by the fuser unit is discharged.

9. The apparatus according to claim 1, wherein the first roller is a press roller and the second roller is a heat roller.

10. An image forming apparatus comprising:

a fuser unit configured to fix toner on a sheet, the fuser unit including a first roller and a second roller opposite to each other;

a first conveyance unit configured to convey the sheet, the first conveyance unit being provided upstream of the fuser unit in a sheet conveyance direction;

a second conveyance unit configured to convey the sheet, the second conveyance unit being provided downstream of the fuser unit in the sheet conveyance direction;

a conveyance drive unit configured to drive the first conveyance unit and the second conveyance unit;

a detection unit configured to detect whether the sheet extends over all of the fuser unit, the first conveyance unit and the second conveyance unit; and a control unit to control the first conveyance unit and the second conveyance unit to move a sheet in the sheet conveyance direction or in the direction opposite to the sheet conveyance direction or in both the directions in a state where the sheet contacts the first roller and the second roller, or in a state where after the sheet is held by the first conveyance unit and the second conveyance unit, one or both of the first conveyance unit and the second conveyance unit move in a direction of approaching at least one of the first roller and the second roller and the sheet contacts the first roller or the second roller.

11. The apparatus according to claim 10, wherein if the detection unit detects that the sheet extends over all of the fuser unit, the first conveyance unit and the second conveyance unit, the control unit controls the first conveyance unit and the second conveyance unit to move the sheet in the sheet conveyance direction or the direction opposite to the sheet conveyance direction or in both the directions.

12. The apparatus according to claim 10, wherein the detection unit is a sensor.

13. The apparatus according to claim 10, wherein the control unit controls the first conveyance unit and the second conveyance unit to move the sheet in the sheet conveyance direction or the direction opposite to the sheet conveyance direction or in both the directions until a previously set time elapses.

14. The apparatus according to claim 10, further comprising a discharge unit configured to discharge a sheet, wherein the discharge unit discharges the sheet conveyed after the sheet is moved in the sheet conveyance direction or the direction opposite to the sheet conveyance direction or in both the directions in the state where the sheet contacts the first roller and the second roller to a position different from a position in a case where the sheet onto which the toner is fixed by the fuser unit is discharged.

15. The apparatus according to claim 10, wherein the first roller is a press roller and the second roller is a heat roller.

16. A fuser unit cleaning method for an image forming apparatus including a fuser unit that includes a first roller and a second roller opposite to each other and fixes an image onto a sheet, a first conveyance unit that is provided upstream of the fuser unit in a sheet conveyance direction and conveys the sheet, a second conveyance unit that is provided downstream of the fuser unit in the sheet conveyance direction and conveys the sheet, and a drive unit to rotate the first roller and the second roller of the fuser unit, the fuser unit cleaning method comprising:

rotating one or both of the first roller and the second roller in a state where a sheet contacts the first roller and the second roller and the sheet is held by the first conveyance unit and the second conveyance unit, or in a state where after the sheet is held by the first conveyance unit and the second conveyance unit, one or both of the first conveyance unit and the second conveyance unit move in a direction of approaching at least one of the first roller and the second roller and the sheet contacts the first roller or the second roller.

17. A fuser unit cleaning method for an image forming apparatus including a fuser unit that includes a first roller and a second roller opposite to each other and fixes an image onto a sheet, a first conveyance unit that is provided upstream of the fuser unit in a sheet conveyance direction and conveys the sheet, a second conveyance unit that is provided downstream of the fuser unit in the sheet conveyance direction and conveys the sheet, a conveyance drive unit to drive the first conveyance unit and the second conveyance unit, and a detection unit configured to detect whether the sheet extends over all of the fuser unit, the first conveyance unit and the second conveyance unit, the fuser unit cleaning method comprising:

moving a sheet in the sheet conveyance direction or in the direction opposite to the sheet conveyance direction or in both the directions in a state where the sheet contacts the first roller and the second roller, or in a state where after the sheet is held by the first conveyance unit and the second conveyance unit as detected by the detection unit, one or both of the first conveyance unit and the second conveyance unit move in a direction of approaching at least one of the first roller and the second roller and the sheet contacts the first roller or the second roller.

* * * * *